US012618131B2

(12) United States Patent
Meyer

(10) Patent No.: US 12,618,131 B2
(45) Date of Patent: May 5, 2026

(54) METHOD OF MANUFACTURING AN ALUMINIUM ALLOY ROLLED PRODUCT

(71) Applicant: NOVELIS KOBLENZ GMBH, Koblenz (DE)

(72) Inventor: Philippe Meyer, Agnetz (FR)

(73) Assignee: Novelis Koblenz GmbH, Koblenz (DE)

( * ) Notice: Subject to any disclaimer, the term of this patent is extended or adjusted under 35 U.S.C. 154(b) by 0 days.

(21) Appl. No.: 17/757,809

(22) PCT Filed: Dec. 18, 2020

(86) PCT No.: PCT/IB2020/062215
§ 371 (c)(1),
(2) Date: Jun. 21, 2022

(87) PCT Pub. No.: WO2021/130636
PCT Pub. Date: Jul. 1, 2021

(65) Prior Publication Data

US 2023/0119583 A1 Apr. 20, 2023

(30) Foreign Application Priority Data

Dec. 23, 2019 (EP) ..... 19219448

(51) Int. Cl.
*C22F 1/057* (2006.01)
*C22C 21/08* (2006.01)
(Continued)

(52) U.S. Cl.
CPC ..... *C22F 1/057* (2013.01); *C22C 21/08* (2013.01); *C22C 21/14* (2013.01); *C22C 21/16* (2013.01); *C22F 1/05* (2013.01); *C22F 1/053* (2013.01)

(58) Field of Classification Search
None
See application file for complete search history.

(56) References Cited

U.S. PATENT DOCUMENTS 5,213,639 A 5/1993 Colvin et al.
5,560,789 A * 10/1996 Sainfort ..... C22C 21/10 148/552
(Continued)

FOREIGN PATENT DOCUMENTS

CN 101823133 A 9/2010
CN 102965603 A 3/2013
(Continued)

OTHER PUBLICATIONS

MacKenzie, D.S. "Heat Treatment Practice of Wrought Age-Hardenable Aluminum Alloys", ASM Handbook vol. 2A, Aluminum Science and Technology, pp. 462-463. (Year: 2018).*
(Continued)

*Primary Examiner* — Keith D. Hendricks
*Assistant Examiner* — Janell C Morillo
(74) *Attorney, Agent, or Firm* — Kilpatrick Townsend & Stockton LLP

(57) ABSTRACT

Described herein is a method of manufacturing an aluminium alloy rolled product of a heat-treatable aluminium alloy, comprising: semi-continuous casting a heat-treatable aluminium alloy into a rolling ingot; homogenizing of the rolling ingot to a peak metal temperature (PMT) and whereby said aluminium alloy has a specific energy associated with a DSC signal less than 2J/g in absolute value; hot rolling of the rolling ingot in multiple hot rolling steps into a hot rolled product having a final rolling gauge of at least 1 mm, whereby the hot rolled product during at least one of the last three rolling steps has a temperature less than 50° C. below PMT; quenching of the hot rolled product at final rolling gauge from hot-mill exit temperature to below 175° C.; optionally stress relieving and ageing of the quenched and optionally stress relieved hot rolled product.

15 Claims, 2 Drawing Sheets

(51) Int. Cl.

| | |
|---|---|
| ***C22C 21/14*** | (2006.01) |
| ***C22C 21/16*** | (2006.01) |
| ***C22F 1/05*** | (2006.01) |
| ***C22F 1/053*** | (2006.01) |
| *C22C 21/18* | (2006.01) |

(56) References Cited

U.S. PATENT DOCUMENTS

| | | | | |
|---|---|---|---|---|
| 6,322,647 | B1 | 11/2001 | Kamat et al. | |
| 6,565,684 | B2 * | 5/2003 | Sigli | C22F 1/053 148/697 |
| 6,994,760 | B2 | 2/2006 | Benedictus et al. | |
| 2004/0079455 | A1 | 4/2004 | Dif et al. | |
| 2012/0085470 | A1 | 4/2012 | Segal | |
| 2016/0333453 | A1 | 11/2016 | Hatta et al. | |
| 2018/0119261 | A1 | 5/2018 | Das et al. | |
| 2019/0136348 | A1 | 5/2019 | Ebzeeva | |

FOREIGN PATENT DOCUMENTS

| | | | |
|---|---|---|---|
| CN | 102517526 | B | 7/2013 |
| CN | 108884524 | A | 11/2018 |
| CN | 109072357 | A | 12/2018 |
| CN | 109790323 | A | 5/2019 |
| CN | 110022999 | A | 7/2019 |
| CN | 110036127 | A | 7/2019 |
| CN | 110168128 | A | 8/2019 |
| CN | 110453122 | A | 11/2019 |
| EP | 2034035 | | 3/2009 |
| EP | 3171996 | | 5/2017 |
| EP | 3299482 | A1 | 3/2018 |
| JP | 2011058047 | A | 3/2011 |
| TW | 200504231 | A | 2/2005 |
| WO | 9741272 | | 11/1997 |
| WO | 2018206696 | | 11/2018 |
| WO | 2019222177 | A1 | 11/2019 |
| WO | 2019238509 | | 12/2019 |

OTHER PUBLICATIONS

European Application No. 19219448.8 , Extended European Search Report, dated Apr. 23, 2020, 7 pages.
European Application No. 19219448.8 , Notice of Decision to Grant, dated Jul. 21, 2022, 2 pages.
International Application No. PCT/IB2020/062215 , International Search Report and Written Opinion, dated Feb. 23, 2021, 12 pages.
Canadian Application No. 3,165,733 , "Office Action", dated Aug. 24, 2022, 4 pages.
Japanese Application No. 2022-538842 , "Office Action", dated Nov. 29, 2022, 9 pages.
Korean Application No. 10-2022-7025201 , "Notice of Decision to Grant", dated Nov. 17, 2022, 8 pages.
Mexican Application No. MX/A/2022/007845 , "Office Action", dated Nov. 29, 2022, 3 pages.
Canadian Application No. 3,165,733 , "Notice of Allowance", dated Feb. 27, 2023, 1 page.
Chinese Application No. 202080097348.0 , "Office Action", dated Feb. 22, 2023, 12 pages.
Japanese Application No. 2022-538842 , "Notice of Allowance", dated Apr. 25, 2023, 4 pages.
Mexican Application No. MX/A/2022/007845 , "Notice of Allowance", dated Mar. 7, 2023, 4 pages.
Brazilian Application No. BR112022012434-1 , "Office Action", dated Apr. 25, 2023, 7 pages.
"Aluminum: Fabrication and Finishing", American Society for Metals, vol. III, 1967, 26 pages.
"American National Standard, Alloy and Temper Designation Systems for Aluminum", Ansi H35.1, Aluminum Association Inc., Apr. 7, 2009, 13 pages.
"Declaration du Dr C. Sigli", May 5, 2023, 2 pages.
"Department of Defense Handbook: Metallic Materials and Elements for Aerospace Vehicle Structures", Department of Defense, Jan. 31, 2003, 28 pages.
"English Translation of CN-102517526-B", Jul. 24, 2013, 23 pages.
"L'aluminium, Par Les Ingenieurs Du Groupe Pechiney, Editions Eyrolles, 61 Boulevard Saint Germain Paris 5ieme", 1964, pp. 662-665.
"Norme ASTM B947", Jan. 2014, 7 pages.
"Rolling Aluminum: From the Mine through the Mill", The Aluminum Association, Inc., 2008, 135 pages.
"Tempers for Aluminum and Aluminum Alloy Products", Yellow Sheets, The Aluminum Association, Jun. 2018, 2 pages.
Anderson, "ASM Handbook vol. 2B Properties and Selection of Aluminum Alloys", First Printing, vol. 2B, Aug. 2019, 9 pages.
CN202080097348.0 , "Notice of Decision to Grant", Aug. 22, 2023, 7 pages.
Davis & Associates , "ASM Specialty Handbook—Aluminum and Aluminum Alloys", Dec. 1993, 4 pages.
Driver , "Design of Aluminum Rolling Processes for Foil, Sheet, and Plate", Handbook of Metallurgical Process Design, Marcel Dekker, Inc., 2004, 48 pages.
European Application No. 19219448.8, "Notice of Opposition", Jun. 2, 2023, 2 pages.
European Application No. 19219448.8, "Notice of Opposition", May 15, 2023, 22 pages.
European Application No. 19219448.8, "Notice of Opposition", May 22, 2023, 30 pages.
Grydin et al., "Water Quenching of Hot-Rolled Aluminum Strips: Process Integrated Heat Treatment of the Alloy EN AW-6082", The Journal of The Minerals, Metals & Materials Society (TMS), vol. 71, No. 1, 2019, pp. 407-418.
Sigli , "Simulation of Aluminum Alloys Homogenization", Proceedings of the 12th International Conference on Aluminium Alloys, Sep. 5-9, 2010, pp. 1544-1549.
Starink , "Analysis of Aluminium Based Alloys by Calorimetry: Quantitative Analysis of Reactions and Reaction Kinetics", International Materials Reviews, vol. 49, No. 3-4, 2004, pp. 191-226.
Chaud, "Le Laminage De L'Aluminium Et De Ses Alliages", Fabrication Des Demi-Produits, pp. 596-597, 1964.
Chaud, "Le Laminage De L'Aluminium Et De Ses Alliages", Fabrication Des Demi-Produits, pp. 592-593, 612-619, 1964.
EP19219448.8 , "Summons to Attend Oral Proceedings", Oct. 30, 2024, 27 pages.
European Patent No. 3842561, "Consolidated List of Citations—Opposition Proceedings," Mar. 27, 2025, 5 pages.
European Patent No. 3842561, "Interlocutory Decision in Opposition Proceedings," Jun. 17, 2025, 64 pages.
Aluminum Association, Inc., The; Registration Record Seres Teal Sheets: International Alloy Designations and Chemical Composition Limits for Wrought Aluminum and Wrought Aluminum Alloys; Revised Aug. 2018, 45 pages.
European Patent No. 3842561, European Opposition, "Statement dated Oct. 21, 2025 forwarding Grounds of Appeal filed Oct. 15, 2025", 42 pages.
Davis, J.R., editor, "ASM Specialty Handbook—Aluminum and Aluminum Alloys," ASM International, Materials Park, Ohio, United States of America, 1993, pp. 290-299.
European Patent No. 3842561, European Opposition, "Summons to Attend Oral Proceedings", Mar. 23, 2026, 4 pages.
European Patent No. 3842561, European Opposition, "Owner's Appeal Brief", Feb. 20, 2026, 13 pages.
Chinese Patent Application No. 202311346695.4, "Office Action", Jan. 14, 2026, 6 pages.
European Patent No. 3842561, European Opposition "Reply to Appeal," Feb. 12, 2026, 16 pages.

* cited by examiner

PRIOR ART

INVENTION

METHOD OF MANUFACTURING AN ALUMINIUM ALLOY ROLLED PRODUCT

CROSS REFERENCE TO RELATED APPLICATION

This application claims the benefit of and priority to European Patent Application No. 19219448.8, filed Dec. 23, 2019 and titled "Method of Manufacturing an Aluminium Alloy Rolled Product," the content of which is herein incorporated by reference in its entirety.

FIELD

Described herein is a method of manufacturing an aluminium alloy sheet, shate or plate product, such as a heat-treatable aluminium alloy. The aluminium alloy sheet, shate or plate product can be used in a wide variety of applications, for example, as tooling plate or shate and armour plate.

BACKGROUND

On an industrial scale, the process or method of manufacturing aluminium alloy rolled sheet, shate and plate products, in particular of heat-treatable aluminium alloys of the 2XXX-, 6XXX- and 7XXX-series aluminium alloys, comprises the process steps of, in that order:

(i). casting of a rolling ingot of the aluminium alloy, and preferably after degassing and filtering of the molten aluminium prior to casting;

(ii). preheating and/or homogenizing of the rolling ingot;

(iii). hot rolling of the ingot into a rolled product at intermediate rolling gauge or final rolling gauge and coiled or cut-to-length and cooled to ambient temperature;

(iv). optionally cold working, e.g., cold rolling, of the hot rolled product to final rolling gauge;

(v). heating from ambient temperature to a target solution heat treatment temperature for solution heat treating ("SHT") of the rolled product to bring as much as possible all or substantially all portions of the soluble elements like zinc, magnesium, manganese and copper into solid solution;

(vi). rapid cooling the SHT rolled product, for example by one of spray quenching or immersion quenching in water or other suitable quenching media to a temperature of 175° C. or lower, and preferably to ambient temperature, to prevent or minimize the uncontrolled precipitation of secondary phases in the aluminium alloy; further, air and air jets may be employed;

(vii). optionally stretching or compressing of the SHT and cooled product to relieve stresses and to improve product flatness; and (viii). ageing, i.e., natural ageing or artificial ageing or a combination thereof, of the rolled product, for example to a T3, T4, T6, T7 or T8 condition depending on the heat-treatable aluminium alloy and condition desired.

The resultant rolled products are of high quality and can be used amongst others for aerospace applications, but also as armour plate and tooling plate.

Each process step requires its own expensive hardware and support tooling and the aluminium alloy products require a lot of handling before and after each process step leading to complex logistical systems in an industrial environment.

An alternative method of making aluminium plate products is by using so-called cast plates. These cast plates are suitable as tooling plate, e.g., for making semi-conductor related devices and for mechanical parts. Such a method, for example, includes the steps of, in that order, melting of an aluminium alloy, degassing and filtering of the molten aluminium prior to casting, casting to produce a slab, and a slicing step for slicing the slab into a predetermined thickness, and preferably a surface smoothening process step. The method comprises preferably a heat treatment step for homogenization performed after the casting step and prior to the slicing step. The aluminium alloys are not subjected to any thermo-mechanical deformation process such as hot rolling. A disadvantage of cast plate is that the unavoidable phases resulting from the combination and precipitation at grain boundaries of elements like iron, manganese, copper, zinc, magnesium, and silicon, often in an eutectic form after solidification, cannot be fully dissolved in the subsequent processing steps like homogenization and SHT and remain as sites for crack initiation, thus lowering the mechanical properties (e.g., ultimate tensile strength, fatigue, elongation, toughness, and others), or as initiators of local corrosion (e.g. pitting corrosion) and may be harmful also for final treatments like anodization. Any oxide layer present in the cast alloy will also remain in its original shape therefore also lowering the mechanical properties. Because substantially the as-cast microstructure is maintained, and strongly depends on the local cooling speed, there is much more variation in mechanical properties as function of the testing location as compared to rolled plate products, rendering cast plates unsuitable for many critical engineering applications.

Existing methods in the art outline that aluminium alloy rolling ingots require a metallurgical homogenization heat treatment before hot rolling. The difference between the homogenization temperature and the hot rolling temperature is between 30° C. and 150° C., depending on the alloys. The ingot must therefore be cooled between leaving the homogenization furnace and the beginning of hot rolling. The desired cooling rate for the ingot is between 150° C./h and 500° C./h. These methods include cooling an aluminium alloy rolling ingot of dimensions 250 to 800 mm in thickness, from 1000 to 2000 mm in width and 2000 to 8000 mm in length after metallurgical homogenization heat treatment of said ingot at a temperature between 450° C. to 600° C. depending on the aluminium alloys and prior to hot rolling wherein cooling, by a value of 30° C. to 150° C., is performed at a rate of from 150 to 500° C./h, with a thermal differential of less than 40° C. over the entire ingot cooled from a homogenization temperature thereof.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

Described herein is a method of manufacturing an aluminium alloy rolled product of a heat-treatable aluminium alloy having a thickness of at least 1 mm, comprising the steps of: semi-continuous casting a heat-treatable aluminium alloy into a rolling ingot having a thickness of at least 250 mm; homogenizing of the rolling ingot to a peak metal temperature (PMT) and whereby said aluminium alloy has a specific energy associated with a DSC signal less than 2 J/g in absolute value; hot rolling of the rolling ingot in multiple hot rolling steps into a hot rolled product having a final rolling gauge of at least 1 mm, whereby the hot rolled product during at least one of the last three rolling steps has a temperature less than 50° C. below PMT; quenching of the hot rolled product at final rolling gauge from hot-mill exit temperature to below 175° C.; optionally stress relieving of the quenched and hot rolled product at final rolling gauge; and ageing of the quenched and optionally stress relieved hot rolled product.

Other objects and advantages of the invention will be apparent from the following detailed description of non-limiting examples and drawings.

DESCRIPTION OF THE DRAWINGS

The invention shall now be described with reference to the appended drawings, in which

FIG. 1 provides a schematic flow chart of the method according to the prior art, for example for manufacturing a plate product of a 7XXX-series aluminium alloy. In a first step 20 rolling feedstock of the 7XXX-series aluminium alloy is cast by semi-continuous casting or continuous casting techniques. The rolling ingot is homogenized and/or pre-heated in step 30, preferably at a temperature in a range of 400° C. to 480° C. The rolling ingot is hot rolled to a thinner gauge in step 40 and upon exiting the last hot rolling stand is coiled (for thinner gauge product) and slowly cooled to ambient temperature or for thicker gauge product slowly cooled to ambient temperature and cut-to-length, and optionally further cold rolling in step 50 to a final gauge and subsequently cut-to-length. At final gauge the rolled product is solution heat-treated, typically at a temperature in a range of 400° C. to 480° C. in step 60 and quenched in step 70. In a stretching operation 80 the product is stress relieved and product flatness is increased, followed by an ageing operation 90, e.g. by means of artificial ageing to a T7651 condition.

FIG. 2 provides a schematic flow chart of the method according to the invention, for example also for manufacturing a plate product of a 7XXX-series aluminium alloy. In a first step 20 rolling feedstock having a thickness of at least 250 mm of the 7XXX-series aluminium alloy is cast by semi-continuous casting, preferably by means of DC-casting. The rolling ingot is homogenized in step 30. The rolling ingot is hot rolled in step 40 to a hot rolled product with a final hot rolled gauge of at least 1 mm, and upon exiting the hot rolling stand quenched in step 45 to below 175° C., and preferably to below 60° C. The hot rolled product is not subjected to a subsequent annealing or solution heat-treatment. Optionally in a stretching operation 80 the hot rolled product at its final hot rolling gauge is stress relieved and to increase product flatness, followed by an ageing operation 90, for example by means of artificial ageing to a T7651 condition using ageing practices regular in the art.

DETAILED DESCRIPTION

Figure 1:
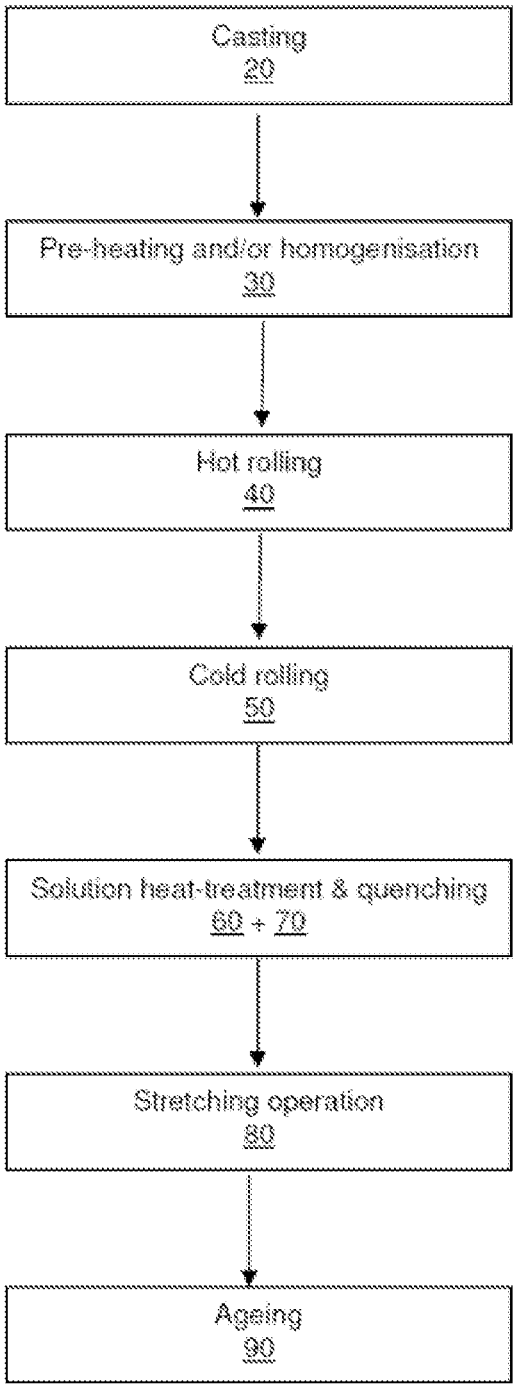
FIG. 1 is a schematic representation of the method according to the prior art.
Figure 2:
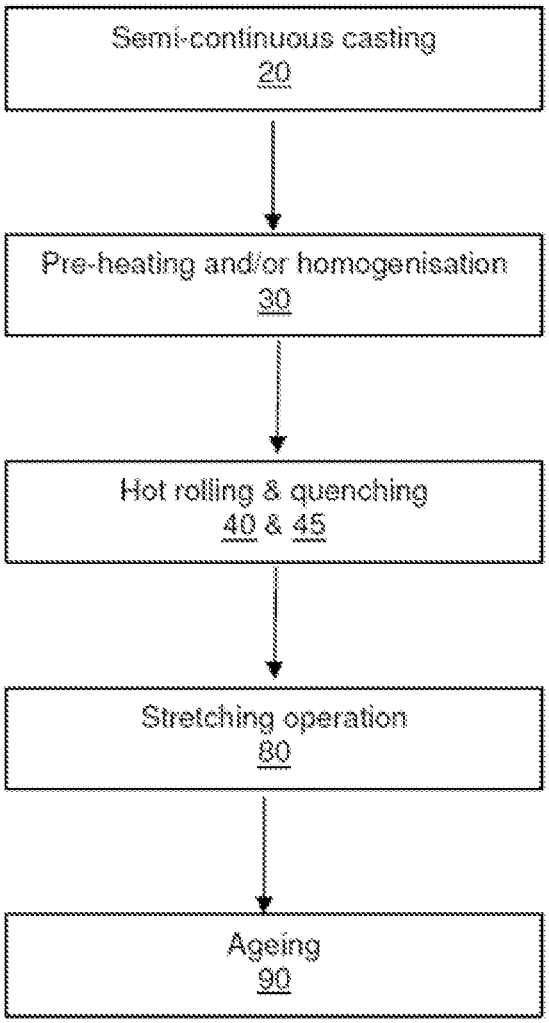
FIG. 2 is a schematic representation of the method according to the invention.

As will be appreciated herein below, except as otherwise indicated, aluminium alloy and temper designations refer to the Aluminium Association designations in Aluminium Standards and Data and the Registration Records, as published by the Aluminium Association in 2018, and which frequently updated, and are well known to the persons skilled in the art. The temper designations are laid down also in European standard EN515.

For any description of alloy compositions or preferred alloy compositions, all references to percentages are by weight percent unless otherwise indicated.

The term "up to" and "up to about", as employed herein, explicitly includes, but is not limited to, the possibility of zero weight-percent of the particular alloying component to which it refers. For example, up to 0.1% Cu may include an aluminium alloy having no Cu.

As used herein, the meaning of "a," "an," or "the" includes singular and plural references unless the context clearly dictates otherwise.

As used herein, a plate generally has a thickness of greater than about 15 mm. For example, a plate may refer to an aluminum product having a thickness of greater than about 15 mm, greater than about 20 mm, greater than about 25 mm, greater than about 30 mm, greater than about 35 mm, greater than about 40 mm, greater than about 45 mm, greater than about 50 mm, or greater than about 100 mm.

As used herein, a shate (also referred to as a sheet plate) generally has a thickness of from about 4 mm to about 15 mm. For example, a shate may have a thickness of about 4 mm, about 5 mm, about 6 mm, about 7 mm, about 8 mm, about 9 mm, about 10 mm, about 11 mm, about 12 mm, about 13 mm, about 14 mm, or about 15 mm.

As used herein, a sheet generally refers to an aluminum product having a thickness of less than about 4 mm. For example, a sheet may have a thickness of less than about 4 mm, less than about 3 mm, less than about 2 mm, less than about 1 mm, less than about 0.5 mm, less than about 0.3 mm, or less than about 0.1 mm.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g., 1 to 6.1, and ending with a maximum value of 10 or less, e.g., 5.5 to 10.

As used herein, the meaning of "ambient temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C.

Described herein is an alternative method of manufacturing aluminium alloy rolled plate products. This and other objects and further advantages are met or exceeded by the present invention providing a method of manufacturing an aluminium alloy rolled product of a heat-treatable aluminium alloy, i.e., a sheet, shate, or plate, having a thickness as described herein (e.g., of at least 1 mm), the method comprising the steps of, in that order:

(a) semi-continuous casting of a rolling ingot having a thickness of at least 250 mm;

(b) preheating and/or homogenizing of the rolling ingot at a peak metal temperature ("PMT") and whereby said aluminium alloy after said preheating and/or homogenizing has a specific energy associated with a Differential Scanning Calorimetry ("DSC") signal less than 2 J/g in absolute value;

(c) hot rolling of the rolling ingot, preferably in multiple hot rolling steps, into a hot rolled product having a final rolling gauge of at least 1 mm, whereby the hot rolled product during at least one of the last three rolling steps or rolling passes has a temperature less than 50° C. below the PMT;

(d) quenching of the hot rolled product at a final hot rolling gauge from hot-mill exit temperature to below 175° C., preferably to below 100° C., and most preferably below 60° C.;

(e) optionally stress relieving of the quenched and hot rolled product at final hot rolling gauge; and (f) ageing, i.e., natural ageing or artificial ageing, of the quenched and optionally stress relieved hot rolled product.

The method described herein is free from or devoid of any annealing or solution heat-treatment following the hot rolling operation to a final rolling gauge of step (c) and prior to any ageing step during step (f).

The methods described herein use a relatively high hot-mill entry temperature and a relatively high hot-mill exit temperature such that the whole or at least substantial parts of the hot rolling process is performed while the aluminium alloy is in a temperature range commonly used for the solution heat-treatment of the subject aluminium alloy and consequently followed by quenching on leaving the hot rolling mill after the last hot rolling step. This avoids the requirement for a next and separate solution heat treatment after the rolling process, making the process described herein more economical as it is more time efficient and it does not require the capacity of a solution heat treatment furnace. The resultant aluminium alloy sheet, shate or plate product offers a desirable set of engineering properties, very similar to or marginally below those produced using a method regular in the art while offering significant costs benefits by avoiding some of the processing steps, in particular the annealing or solution heat-treatment, required in methods regular in the art.

The aluminium alloy is provided as an ingot or slab for fabrication into a rolled product by semi-continuous casting techniques, e.g., Direct-Chill (DC)-casting, Electro-Magnetic-Casting (EMC)-casting, and Electro-Magnetic-Stirring (EMS)-casting. In a preferred embodiment, the semi-continuous casting is by means of DC-casting a rolling ingot. The semi-continuous cast rolling ingot has a thickness of at least 250 mm, and preferably of more than about 350 mm. The maximum thickness is about 800 mm and preferably about 600 mm. Starting from thick gauge semi-continuous cast rolling ingots of at least 250 mm compared to using a much thinner gauge continuous casting ingots (e.g. up to about 40 mm) results in a higher deformation degree in the rolled product and in the breaking up of, e.g., constituent particles, leading to higher strength and better damage tolerance properties when aged to final temper. A higher deformation degree also results in favourably breaking up and significantly reducing to size of any oxides in the as-cast structure, if any might still be present after a degassing and filtering operation. Grain refiners such as those containing titanium and boron, or titanium and carbon, may also be used as is known in the art. The Ti-content in the aluminium alloy is up to 0.15%, for example in a range of 0.01% to 0.1%. Optionally, the semi-continuous cast rolling ingot is stress relieved, in particular with the high alloyed 2XXX- and 7XXX-series aluminium alloys, for example by holding it at a temperature in a range of about 275° C. to 450° C., for example about 300° C. to 400° C., for up to about 24 hours, e.g., 10 to 20 hours, and preferably followed by slow cooling to ambient temperature. After semi-continuous casting of the rolling ingot, the rolling ingot is commonly scalped to remove segregation zones near the as-cast surface of the ingot and to improve rolling ingot flatness and surface quality.

The purpose of the homogenization heat-treatment is at least: (i) to dissolve as much as possible coarse soluble phases formed during solidification, and (ii) to reduce local concentration gradients (micro-segregation) to facilitate the dissolution step. A preheat treatment achieves also some of these objectives. Preferably in the method described herein, the rolling ingot is at least homogenized at conditions which allow to simplify the subsequent steps of the manufacturing process and in particular overcome the requirement of a solution heat treatment after hot rolling.

Commonly, a pre-heat refers to the heating of a rolling ingot to a set temperature and soaking at this temperature for a set time followed by the start of the hot rolling at about that temperature. Homogenization refers to a heating, soaking and cooling cycle with one or more soaking steps, applied to a rolling ingot in which the final temperature after homogenization is ambient temperature. The soaking at the highest temperature applied in a homogenization cycle is referred to at the peak metal temperature ("PMT"). Thereafter the homogenized ingot is re-heated or preheated to the start hot rolling temperature, also referred to as the hot-mill entry temperature.

As known in the art, homogenization may be carried out in one stage or several stages of increasing temperature to avoid incipient melting. This is achieved by allowing the phases present in the as-cast condition to progressively dissolve, thereby increasing the temperature of incipient melting of the remaining phases. Where a homogenization cycle is applied of two or more soaking steps or stages at different and increasing temperatures, the PMT refers to the soaking step at the highest temperature employed in that cycle. For example, in a two-step homogenization process for a typical 7xxx-series alloy, there is a first step between about 455° C. and 470° C., e.g. at about 469° C., and a second step between about 470° C. and 485° C., e.g. at about 475° C., to optimize the dissolving process of the various phases depending on the exact or given aluminium alloy composition. In this example, the temperature of about 475° C. is the peak metal temperature.

In a preferred embodiment, in a homogenization cycle, also of two or more soaking steps, the PMT is not followed before hot rolling by a soaking at a temperature lower than the PMT other than progressive cooling from PMT to hot rolling entry temperature, keeping this rolling entry temperature as close as possible to the PMT. This is to avoid the formation of adverse precipitates.

The soaking time at the homogenization temperature(s) is in the range of about 1 to 50 hours, for example for about 2 to 35 hours. Optionally, the soaking time at the homogenization temperature is from 2 to 45 hours, 3 to 40 hours, 4 to 35 hours, 5 to 30 hours, 6 to 25 hours, or 10 to 20 hours. The heat-up rates that can be applied are those which are determined by one of skill in the art.

As the hot rolled product does not receive any subsequent solution heat-treatment following any stage after the hot rolling process and to ensure that a desired set of mechanical properties is obtained, it is an important feature of the method described herein to bring at the peak metal temperature (PMT) as much as possible into solid solution all or substantially all portions of the soluble elements and phases contributing to the hardening of the aluminium alloy, e.g. elements like zinc, magnesium, copper, silicon, manganese and lithium. The PMT should be as high as possible while avoiding melting of the aluminium alloy used. For 2XXX- and 7XXX-series aluminium alloys, this means that the PMT temperature should be preferably less than 15° C. below an incipient melting temperature of the subject aluminium alloy, and more preferably less than 10° C., and most preferably less than 7.5° C. below an incipient melting temperature of the subject aluminium alloy. The PMT for the homogenization step is aluminium alloy dependent and for 2XXX-series aluminium alloys typically in a range of about 430° C. to 505° C., and preferably in a range of about 470° C. to 500° C.; for 6XXX-series aluminium alloys typically in a range of about 480° C. to 580° C., and preferably in a range of about 500° C. to 560° C.; and for 7XXX-series aluminium alloys typically in a range of about 430° C. to 490° C., and preferably in a range of about 470° C. to 485° C.

The quality of homogenization is commonly verified by techniques like Differential Scanning Calorimetry ("DSC"). It has been found that after the pre-heat and/or homogenization and prior to the hot rolling operation that for the subject or given aluminium alloy the residual melting peak of phases must be below 2 J/g in absolute value. In a preferred embodiment it is below 1.0 J/g, and more preferably below 0.5 J/g, and most preferably below 0.2 J/g. This is commonly measured in the art at samples taken from a location in the rolling ingot richest in alloying elements. As a result of macro-segregation of alloying elements resulting from the semi-continuous casting operation, the samples are therefore to be taken from the location third-thickness and quarter-width of the rolling ingot. A preferred measurement apparatus is the TA Instruments 910 DSC (TA Instruments; New Castle, DE) using a heating rate of 20° C./min from room temperature until final melting of the specimen weighing about 45 mg in the DSC apparatus. The measurements are performed in the temperature range between 50° C. and 600° C. and A199.995 is used as the reference material. The sample chamber is purged continuously during the testing with argon gas at a flow rate of 300 ml/min.

Another important feature of the method described herein is the hot rolling process wherein the rolling ingot in multiple hot rolling steps or hot rolling passes is rolled into a hot rolled product having a final rolling gauge of at least 1 mm, and whereby the rolling temperature is controlled such that the hot rolled product during at least one of the last three rolling steps or hot rolling passes has a temperature less than about 50° C. below the PMT applied during the homogenization step. In an embodiment, the hot rolled product during at least one of the last three rolling steps has a temperature less in a range of about 5° C. to 50° C. below the PMT, and more preferably in a range of about 5° C. to 40° C. below the PMT. For example, the hot rolled product has a temperature of about 5° C., about 10° C., about 15° C., about 20° C., about 25° C., about 30° C., about 35° C., about 40° C., about 45° C. below PMT, or anywhere in between. In preferred embodiment of the hot rolling process, the hot rolled product has a temperature in this temperature range during the last rolling step or rolling pass on leaving or exiting the hot rolling mill. The high hot rolling exit temperature ensures that all or substantially all of the alloying elements remain into solid solution during the hot rolling operation followed by a quenching step on exciting the last hot rolling stand.

In an embodiment the hot-mill entry temperature is in a temperature range of less than about 40° C. below PMT applied during the homogenization step, preferably in a range of about 5° C. to 40° C. below the PMT of the subject or given aluminium alloy, and preferably in a range of about 5° C. to 30° C. below the PMT of the subject or given aluminium alloy. For example, the hot-mill entry temperature can be about 5° C., about 10° C., about 15° C., about 20° C., about 25° C., about 30° C., about 35° C., about 40° C. below PMT, or anywhere in between.

Depending on the final gauge of the hot rolled product in a first hot rolling operation, the heated rolling ingot is subjected to breakdown hot rolling in one or more passes using reversing or non-reversing mill stands that serve to reduce the thickness of the feedstock to a gauge range of about 15 mm or more. Next after breakdown hot rolling, the feedstock can be supplied to a mill for hot finishing rolling in one or more passes to a final gauge in the range of 1 mm to 15 mm, for example about 3 mm or about 10 mm. The hot finishing rolling operation can be done for example using a reverse mill or a tandem mill.

In an embodiment of the method, the aluminium alloy is hot rolled to final hot rolling gauge using a hot-mill entry temperature in a temperature range of less than about 40° C. below the PMT applied during the homogenization step, and with preferred ranges as herein described, and whereby the rolling temperature is controlled such that the hot rolled product during at least one of the last three rolling steps or hot rolling passes has a temperature less than about 50° C. below the PMT applied during the homogenization step, and with preferred ranges as herein described.

In an embodiment of the method the aluminium alloy is hot rolled in a first series of hot rolling steps to an intermediate hot rolled gauge, followed by an intermediate heating step and then hot rolled in a second series of hot rolling steps to final hot rolled gauge. Preferably at intermediate hot rolled gauge the rolling product is rapidly cooled or quenched to below about 150° C., and preferably to below 100° C., for ease of handling and to avoid the formation of coarse precipitates. Next the rolling product is re-heated to a temperature in the range of less than about 40° C. below the PMT applied during the homogenization step, preferably in a range of about 5° C. to 40° C. below the PMT of the subject or given aluminium alloy, and preferably in a range of about 5° C. to 30° C. below the PMT of the subject aluminium alloy, and with preferred ranges as herein described, to ensure that as much as possible all or substantially all portions of the soluble elements and phases contributing to the hardening of the aluminium alloy are brought back into solid solution, and followed by a second series of hot rolling steps to final hot rolled gauge.

In another embodiment of the method the aluminium alloy is hot rolled in a first series of hot rolling steps to an intermediate hot rolled gauge, followed by an intermediate heating step and then hot rolled in a second series of hot rolling steps to final hot rolled gauge. Preferably at intermediate hot rolled gauge the rolling product is as quickly as possible brought to the intermediate reheating, to minimize the loss of temperature, typically to avoid falling more than about 150° C. below PMT, and preferably to avoid falling below more than about 100° C. below PMT. Next the rolling product is re-heated to a temperature in the range of less than about 40° C. below the PMT applied during the homogenization step, preferably in a range of about 5° C. to 40° C. below the PMT of the subject or given aluminium alloy, and preferably in a range of about 5° C. to 30° C. below the PMT of the subject aluminium alloy, and with preferred ranges as herein described, to ensure that as much as possible all or substantially all portions of the soluble elements and phases contributing to the hardening of the aluminium alloy are brought back into solid solution, and followed by a second series of hot rolling steps to final hot rolled gauge.

In another embodiment of the method the aluminium alloy is hot rolled in a first series of hot rolling steps to an intermediate hot rolled gauge whereby the hot rolling entry temperature is as known to those of skill in the art for the subject aluminium alloy and which is typically lower than the preferred hot mill entry temperature for the method as described herein. When at intermediate hot rolled gauge, the rolling stock is re-heated to a temperature in the range of less than about 40° C. below the PMT applied during the homogenization step, preferably in a range of about 5° C. to 40° C. below the PMT of the subject aluminium alloy, and preferably in a range of about 5° C. to 30° C. below the PMT of the subject or given aluminium alloy, and with preferred ranges as herein described, to ensure that as much as possible all or substantially all portions of the soluble elements and phases contributing to the hardening of the aluminium alloy are brought back into solid solution, and followed by a second series of hot rolling steps to final hot rolled gauge.

In an embodiment, the aluminium alloy product has been hot rolled in process step (c) in a hot rolling mill in multiple hot rolling steps or hot rolling passes into a hot rolled product having a final rolling gauge of at least 1.0 mm. In a preferred embodiment the final rolling gauge is at least 1.5 mm, and more preferably at least 3 mm. In a further embodiment the final rolling gauge is at least 5 mm, preferably at least 15 mm and more preferably at least 25.4 mm (1.0 inches).

In an embodiment, the aluminium alloy product has been hot rolled in process step (c) in a hot rolling mill in multiple hot rolling steps or hot rolling passes into a hot rolled product having a final rolling gauge of maximum 254 mm (10.0 inches). In an embodiment the final rolling gauge is maximum 203.2 mm (8.0 inches). In an embodiment the final rolling gauge is maximum 152.4 mm (6.0 inches), and preferably maximum 101.6 mm (4.0 inches).

In an embodiment, the aluminium alloy product has been hot rolled in process step (c) in a hot rolling mill in multiple hot rolling steps or hot rolling passes into a hot rolled shate product having a final rolling gauge in a range of 5.0 mm to 12 mm, and preferably of 5.0 mm to 10 mm.

In the quenching step (d), the aluminium alloy rolled product is quenched with a liquid (e.g., water, oil, or a water-oil emulsion) and/or gas (e.g., air) or another selected quench medium. In an embodiment of the quenching operation during step (d) the quench rate is at least from about 10° C./sec to about 600° C./sec, and preferably of at least about 20° C./sec to about 500° C./sec, for at least in the temperature range from hot-mill exit temperature to about 175° C. or less, and preferably to below about 100° C. or less. For example, quenching can be performed at a rate of about 30° C./sec, about 40° C./sec, about 50° C./sec, about 70° C./sec, about 80° C./sec, about 90° C./sec, about 100° C./sec, about 200° C./sec, about 300° C./sec, about 400° C./sec, about 500° C./sec, about 600° C./sec, or anywhere in between. In an embodiment described herein, the quenching operation is to reduce the aluminium alloy hot rolled product from the hot-mill exit temperature to a temperature of about 60° C. or less, or to about ambient temperature e.g. of about 30° C. or about 25° C. or about 20° C.

In a preferred embodiment of the invention the quenching operation during step (d) is performed in-line with the hot rolling operation, more preferably at least in-line with the at least three hot rolling steps or hot rolling passes.

Following the quenching operation the cooled rolled product may be coiled for the thinner gauge rolled product (typically having a gauge of less than 10 mm) or for the thicker gauge products cut-to-length (typically having a gauge or more than 10 mm, more typically having a gauge of more than 15 mm, and most typically having a gauge of more than 25.4 mm).

In an embodiment, in particular for the 2XXX and 7XXX-series aluminium alloys, the hot rolled and quenched rolled stock at final rolling gauge may be stress relieved. Stress relieving can be done by cold rolling, stretching, levelling or compressing.

In an embodiment the stress relieving and product flatness improvement during step (e) is done by means of cold rolling, preferably at ambient temperature, by applying a cold rolling reduction of less than 5% of its original thickness prior to the cold rolling operation. Preferably the cold rolling reduction is less than 3%, and more preferably less than 1% of its original thickness. Other than for this purpose in the method according to this invention no further cold rolling step or cold rolling operation is being carried onto the aluminium alloy rolled product.

In another embodiment the stress relieving during step (e) is done by means of levelling in the range of about 0.1% to 5% of its original length to relieve residual stresses therein and to improve the flatness of the rolled product. Preferably the levelling is in the range of about 0.1% to 2%, more preferably of about 0.1% to 1.5%. Preferably the levelling operation is performed at ambient temperature.

In a preferred embodiment the stress relieving during step (e) is done by means of stretching in the range of about 0.5% to 8% of its original length to relieve residual stresses therein and to improve the flatness of the rolled product. Preferably the stretching is in the range of about 0.5% to 6%, more preferably of about 1% to 3%. Preferably the stretching operation is performed at ambient temperature.

In process step (f) the aluminium alloy rolled product is aged, i.e., natural ageing or artificial ageing or a combination thereof, in particular to a T3, T4, T6, T7 or T8 temper depending on the heat-treatable aluminium alloy used and the condition desired to achieve final mechanical properties.

In an embodiment in a next process step, for example a desired structural shape or near-net structural shape may then be machined from the aged plate product or section.

In the embodiment where the aluminium alloy is a 2XXX-series aluminium alloy the ageing to a desired temper to achieve final mechanical properties is selected from the group of: T3, T4, T6, and T8. The artificial ageing step for the T6 and T8 temper preferably includes at least one ageing step at a temperature in the range of 130° C. to 210° C. for a soaking time in a range of 4 to 30 hours.

In a preferred embodiment the ageing of the 2XXX-series aluminium alloy to a desired temper to achieve final mechanical properties is by natural ageing to a T3 temper, more preferably a T351, T37 or T39 temper.

In a preferred embodiment the ageing of the 2XXX-series aluminium alloy to a desired temper to achieve final mechanical properties is to a T6 temper.

In a preferred embodiment the ageing of the 2XXX-series aluminium alloy to a desired temper to achieve final mechanical properties is to a T8 temper, more preferably a T851, T87 or T89 temper.

In the embodiment where the aluminium alloy is a 6XXX-series aluminium alloy the ageing to a desired temper to achieve final mechanical properties is selected from the group of: T4 and T6.

In the embodiment where the aluminium alloy is a 7XXX-series aluminium alloy the ageing to a desired temper to achieve final mechanical properties is selected from the group of: T4, T5, T6, and T7. The ageing step preferably includes at least one ageing step at a temperature in the range of 120° C. to 210° C. for a soaking time in a range of 4 to 30 hours.

In an embodiment the ageing of the 7XXX-series aluminium alloy to a desired temper to achieve final mechanical properties is to a T6 temper.

In a preferred embodiment the ageing of the 7XXX-series aluminium alloy to a desired temper to achieve final mechanical properties is to a T7 temper, more preferably a T73, T74, T76, T77 or T79 temper.

The hot rolling ingot or slab for fabrication into a rolled product may be provided with a cladding on either or both sides thereof and this composite is then processed in accordance with the method described herein. In particular, such a cladding is useful when processing 2XXX-series aluminium alloys, e.g. those of the 2X24-series. Such clad or composite products utilize a core of the heat-treatable aluminium alloy and a cladding typically of higher purity alloy which corrosion protects the core. The cladding includes, but is not limited to, essentially unalloyed aluminium or aluminium containing not more than 0.1% or 1% of all other elements. Aluminium alloys herein designated 1xxx-type series include all Aluminium Association (AA) alloys, including the sub-classes of the 1000-type, 1100-type, 1200-type and 1300-type. Thus, the cladding on the core may be selected from various Aluminium Association alloys such as 1060, 1045, 1100, 1200, 1230, 1135, 1235, 1435, 1145, 1345, 1250, 1350, 1170, 1175, 1180, 1185, 1285, 1188, 1199, or 7072. In addition, in particular for the 2XXX-series core alloys, the AA7XXX-series alloys, such as 7072 containing zinc (0.8% to 1.3%), can serve as the cladding and alloys of the AA6XXX-series alloys, such as 6003 or 6253, which contain typically more than 1% of alloying additions, can serve as cladding. Other alloys could also be useful as cladding as long as they provide in particular sufficient overall corrosion protection to the core alloy. The clad layer or layers are usually much thinner than the core, each constituting about 1% to 15% or 20% or possibly 25% of the total composite thickness. A cladding layer more typically constitutes around about 1% to 12% of the total composite thickness.

The method according to the invention is of particular use for the production of shate or plate products of heat-treatable aluminium alloys, in particular those of the 2XXX, 6XXX and 7XXX-series aluminium alloys.

In an embodiment the 2XXX-series alloy is from an aluminium alloy having a composition comprising, in wt. %:

Cu 1.9% to 7%, preferably 3.0% to 6.8%, more preferably 3.2% to 4.95%,
Mg 0.3% to 2%, preferably 0.8% to 1.8%,
Mn up to 1.2%, preferably 0.2% to 1.2%, more preferably 0.2 to 0.9%,
Si up to 0.4%, preferably up to 0.25%,
Fe up to 0.4%, preferably up to 0.25%,
Cr up to 0.35%, preferably up to 0.20%,
Zn up to 0.4%,
Ti up to 0.15%, preferably 0.01% to 0.1%,
Zr up to 0.25, preferably up to 0.12%,
V up to 0.25%,
balance being aluminium and impurities. Typically, such impurities are present each <0.05%, total <0.15%.

In preferred embodiment the 2XXX-series aluminium alloy is from an AA2X24-series aluminium alloy, wherein X is equal to 0, 1, 2, 3, 4, 5, 6, 7, or 8. A particular preferred aluminium alloy is within the range of AA2024, AA2524, and AA2624.

Optionally, the aluminum alloy can be a 2XXX-series aluminum alloy according to one of the following aluminium alloy designations: AA2001, A2002, AA2004, AA2005, AA2006, AA2007, AA2007A, AA2007B, AA2008, AA2009, AA2010, AA2011, AA2011A, AA2111, AA2111A, AA2111B, AA2012, AA2013, AA2014, AA2014A, AA2214, AA2015, AA2016, AA2017, AA2017A, AA2117, AA2018, AA2218, AA2618, AA2618A, AA2219, AA2319, AA2419, AA2519, AA2021, AA2022, AA2023, AA2025, AA2026, AA2027, AA2028, AA2028A, AA2028B, AA2028C, AA2029, AA2030, AA2031, AA2032, AA2034, AA2036, AA2037, AA2038, AA2039, AA2139, AA2040, AA2041, AA2044, AA2045, AA2050, AA2055, AA2056, AA2060, AA2065, AA2070, AA2076, AA2090, AA2091, AA2094, AA2095, AA2195, AA2295, AA2196, AA2296, AA2097, AA2197, AA2297, AA2397, AA2098, AA2198, AA2099, or AA2199.

In an embodiment the 6XXX-series alloy is from an aluminium alloy having a composition comprising, in wt. %:

Si 0.2% to 1.7% preferably 0.5% to 1.5%,
Mg 0.1% to 1.5%, preferably 0.15% to 1.2%, most preferably 0.15% to 0.9%,
Fe up to 0.5%, preferably up to 0.25%,
Cu up to 1.0%, preferably up to 0.6%, most preferably up to 0.2%,
Mn up to 1.0%,
Cr up to 0.3%, preferably up to 0.25%,
Ti up to 0.15%, preferably 0.005% to 0.1%,
Zn up to 1.0%, preferably up to 0.5%, most preferably up to 0.3%,
balance being aluminium and impurities. Typically, such impurities are present each <0.05%, total <0.15%.

In an embodiment the 6XXX-series aluminium alloy is selected from the group of 6011, 6016, 6056, 6061, 6063, and 6082, and near-compositional variations thereof.

Optionally, the aluminum alloy can be a 6XXX series aluminum alloy according to one of the following aluminium alloy designations: AA6101, AA6101A, AA6101B, AA6201, AA6201A, AA6401, AA6501, AA6002, AA6003, AA6103, AA6005, AA6005A, AA6005B, AA6005C, AA6105, AA6205, AA6305, AA6006, AA6106, AA6206, AA6306, AA6008, AA6009, AA6010, AA6110, AA6110A, AA6011, AA6111, AA6012, AA6012A, AA6013, AA6113, AA6014, AA6015, AA6016, AA6016A, AA6116, AA6018, AA6019, AA6020, AA6021, AA6022, AA6023, AA6024, AA6025, AA6026, AA6027, AA6028, AA6031, AA6032, AA6033, AA6040, AA6041, AA6042, AA6043, AA6151, AA6351, AA6351A, AA6451, AA6951, AA6053, AA6055, AA6056, AA6156, AA6060, AA6160, AA6260, AA6360, AA6460, AA6460B, AA6560, AA6660, AA6061, AA6061A, AA6261, AA6361, AA6162, AA6262, AA6262A, AA6063, AA6063A, AA6463, AA6463A, AA6763, A6963, AA6064, AA6064A, AA6065, AA6066, AA6068, AA6069, AA6070, AA6081, AA6181, AA6181A, AA6082, AA6082A, AA6182, AA6091, or AA6092.

In an embodiment the method is to manufacture a 6XXX-series aluminium alloy tooling shate or plate product for manufacturing semi-conductor related devices, in particular vacuum chamber elements obtained from the aluminium alloy plate. Vacuum chamber elements are elements for the manufacture of vacuum chamber structures and the internal components of the vacuum chamber, such as vacuum chamber bodies, valve bodies, flanges, connecting elements, sealing elements, diffusers and electrodes. They are in particular obtained by machining and surface treatment, i.e. anodization, of aluminium alloy plates.

In an embodiment the 7xxx-series aluminium alloy has a composition comprising, in wt. %:

| | |
|---|---|
| Zn | 4% to 9.8%, preferably 5.5% to 8.7%, |
| Mg | 1% to 3%, |
| Cu | up to 2.5%, preferably 1% to 2.5%, |

and optionally one or more elements selected from the group consisting of:

| | |
|---|---|
| Zr | up to 0.3%, |
| Cr | up to 0.3%, |
| Mn | up to 0.45%, |
| Ti | up to 0.15%, preferably up to 0.1%, |
| Sc | up to 0.5%, |
| Ag | up to 0.5%, |
| Fe | up to 0.3%, preferably up to 0.15%, |
| Si | up to 0.3%, preferably up to 0.15%, |

impurities and balance aluminium. Typically, such impurities are present each <0.05% and total <0.15%.

Optionally, the aluminium alloy can be a 7XXX series aluminium alloy according to one of the following aluminium alloy designations: AA7019, AA7020, AA7021, AA7085, AA7108, AA7108A, AA7015, AA7017, AA7018, AA7030, AA7033, AA7046, AA7046A, AA7003, AA7009, AA7010, AA7012, AA7016, AA7116, AA7122, AA7023, AA7026, AA7029, AA7129, AA7229, AA7032, AA7033, AA7036, AA7136, AA7040, AA7140, AA7041, AA7049, AA7049A, AA7149, AA7249, AA7349, AA7449, AA7050, AA7050A, AA7150, AA7250, AA7055, AA7155, AA7255, AA7056, AA7060, AA7064, AA7065, AA7068, AA7168, AA7075, AA7175, AA7475, AA7278A, AA7081, AA7181, AA7185, AA7090, AA7099, or AA7199.

In an embodiment of the invention the method is to manufacture an aluminium alloy tooling shate or plate product or a non-aerospace construction shate or plate.

In an embodiment of the invention the method is to manufacture an aluminium alloy armour plate product, in particular as part of an underbody structure of an armoured vehicle providing mine blast resistance, the door of an armoured vehicle, the engine hood or front fender of an armoured vehicle, a turret. The aluminium alloy armour plate product is preferably from a 7XXX-series alloy, and this would include 7XXX-series aluminium alloys selected from the group of AA7020, AA7449, AA7050, AA7056, AA7081, AA7181, AA7085, AA7185, and near-compositional modifications thereof.

EXAMPLES

On an industrial scale of semi-continuous DC-casting an aluminium alloy rolling ingot of 440 mm thickness and 1740 mm wide has been cast.

The aluminium alloy consisted of 6.55% Zn, 2.37% Mg, 2.15% Cu, 0.10% Zr, 0.10% Fe, and 0.07% Si, balance unavoidable impurities and aluminium.

The cast ingot was stress relieved by soaking at 350° C. for about 12 hours followed by cooling to ambient temperature.

The DSC measurement on as-cast stress relieved samples was performed with a standard heat-up rate of 20° C./min from room temperature until final melting of the specimen in a TA Instruments 910 DSC equipment This measurement indicated a peak of melting eutectic phases at 482° C. of 18.7 J/g, a peak of melting S phases at 488° C. of 0.3 J/g, and a peak of melting $Mg_2Si$ phases at 542° C. of 0.5 J/g, in total 19.5 J/g.

In accordance with the method described herein, the rolling ingot was homogenized by heating to 470° C. at an average heat-up speed of about 35° C./hour, followed by 12 hours soak at 470° C., next a heat-up to 475° C. at about 35° C./hour, followed by 25 hours soak at 475° C., and cooling to ambient temperature. The soaking at 475° C. is the highest temperature applied in this two-stage homogenization cycle and is also the last step has the highest temperature in this cycle; thus 475° C. is the peak metal temperature (PMT).

The DSC measurement of the homogenized material was performed on a sample of 30×30×10 mm taken at third-thickness and quarter-width of the ingot, subjected to the above mentioned homogenization cycle and water quenched, out of which with a DSC specimen of 45 mg has been taken, subjected to standard heat-up rate of 20° C./min from room temperature until final melting of the specimen under argon atmosphere in a TA Instruments 910 DSC equipment. This resulted in a peak of total melting of residual phases of 0.5 J/g providing a very good homogenized aluminium alloy ingot and highly suitable for use in the method according to this invention.

The homogenized rolling ingot is then quickly transported to a first hot rolling stand and next hot rolled in multiple rolling steps to a plate of 70 mm final thickness and then on exiting the last hot rolling step subjected to a water quenching with an emulsion down to about 60° C. The hot-roll starting temperature was about 470° C. and the hot rolling exit temperature was about 450° C.

The aluminium alloy plate product has been subjected to an artificial ageing treatment and tested for its mechanical properties.

Illustrations

Illustration 1 is a method of manufacturing an aluminium alloy rolled product of a heat-treatable aluminium alloy having a thickness of at least 1 mm, comprising the steps of: (a) semi-continuous casting a heat-treatable aluminium alloy into a rolling ingot having a thickness of at least 250 mm; (b) preheating and/or homogenizing of the rolling ingot to a peak metal temperature (PMT) and whereby said aluminium alloy has a specific energy associated with a Differential Scanning Calorimetry (DSC) signal less than 2 J/g in absolute value; (c) hot rolling of the rolling ingot in multiple hot rolling steps into a hot rolled product having a final rolling gauge of at least 1 mm, whereby the hot rolled product during at least one of the last three rolling steps has a temperature less than 50° C. below PMT (° C.); (d) quenching of the hot rolled product at final rolling gauge from hot-mill exit temperature to below 175° C.; (e) optionally stress relieving of the quenched and hot rolled product at final rolling gauge; and (f) ageing of the quenched and optionally stress relieved hot rolled product.

Illustration 2 is the method according to any preceding or subsequent illustration, wherein the method is free from any solution heat-treatment following the hot rolling to a final hot rolling gauge of step (c).

Illustration 3 is the method according to any preceding or subsequent illustration, wherein the quenching during step (d) is performed in-line with at least the last hot rolling step.

Illustration 4 is the method according to any preceding or subsequent illustration, wherein the aluminium alloy is selected from the group of 2XXX-, 6XXX, and 7XXX-series aluminium alloys.

Illustration 5 is the method according to any preceding or subsequent illustration, wherein said aluminium alloy has a specific energy associated with a DSC signal less than 1.0 J/g in absolute value, and preferably of less than 0.5 J/g in absolute value.

Illustration 6 is the method according to any preceding or subsequent illustration, wherein for 2XXX- and 7XXX-series aluminium alloy products the PMT is less than 15° C., and preferably less than 10° C. below an incipient melting temperature of a given aluminium alloy.

Illustration 7 is the method according to any preceding or subsequent illustration, wherein the hot-mill entry temperature is in a temperature range of less than 40° C. below the PMT of the aluminium alloy, and preferably of less than 30° C. below the solidus temperature of the aluminium alloy.

Illustration 8 is the method according to any preceding or subsequent illustration, wherein the hot-mill exit temperature of the hot rolled product at final rolling gauge is in a temperature range of less than 40° C. below the PMT of the aluminium alloy, and preferably in a range of less than 30° C. below the PMT of the aluminium alloy.

Illustration 9 is the method according to any preceding or subsequent illustration, wherein by during step (e) the stress relieving is by stretching in a range of about 0.5% to 8% of its original length, and preferably in a range of about 0.5% to 6% of its original length.

Illustration 10 is the method according to any preceding or subsequent illustration, wherein the hot rolled product at final hot rolling gauge is 5 mm or more, preferably 10 mm or more, and more preferably 25.4 mm or more.

Illustration 11 is the method according to any preceding or subsequent illustration, wherein during step (c) the rolling ingot is hot rolled in a first series of hot rolling steps to an intermediate hot rolled gauge, followed by an intermediate heating step and then in a second series of hot rolling steps hot rolled to final hot rolled gauge of at least 1 mm.

Illustration 12 is the method according to any preceding or subsequent illustration, wherein the intermediate heating step is to a temperature in the range of less than 40° C. below the PMT of the aluminium alloy, and preferably of less than 30° C. below the PMT of the aluminium alloy.

Illustration 13 is the method according to any preceding or subsequent illustration, wherein the aluminium alloy is a 2XXX-series aluminium alloy having composition comprising, in wt. %:

| | |
|---|---|
| Cu | 1.9% to 7%, preferably 3.0% to 6.8%, |
| Mg | 0.3% to 2%, |
| Mn | up to 1.2%, |
| Si | up to 0.4%, |
| Fe | up to 0.4%, |
| Cr | up to 0.35%, |
| Zn | up to 0.4%, |
| Ti | up to 0.15%, |
| Zr | up to 0.25, |
| V | up to 0.25%, balance being aluminium and impurities. |

Illustration 14 is the method according to any preceding or subsequent illustration, wherein the aluminium alloy is a 6XXX-series aluminium alloy having a composition comprising, in wt. %:

| | |
|---|---|
| Si | 0.2% to 1.7%, preferably 0.5% to 1.5%, |
| Mg | 0.1% to 1.5%, preferably 0.15% to 1.2%, |
| Fe | up to 0.5%, |
| Cu | up to 1.0%, preferably up to 0.6%, |
| Mn | up to 1.0%, |
| Cr | up to 0.3%, |
| Ti | up to 0.15%, |
| Zn | up to 1.0%, balance being aluminium and impurities. |

Illustration 15 is the method according to any preceding or subsequent illustration, wherein the aluminium alloy is a 7XXX-series aluminium alloy having a composition comprising, in wt. %:

| | |
|---|---|
| Zn | 4% to 9.8%, preferably 5.5% to 8.7%, |
| Mg | 1% to 3%, |
| Cu | up to 2.5%, preferably 1% to 2.5%, |

and optionally one or more elements selected from the group consisting of:

| | |
|---|---|
| Zr up to 0.3%, Cr up to 0.3%, Mn up to 0.45%, | |
| Ti up to 0.15%, Sc up to 0.5%, Ag up to 0.5%, | |
| Fe | up to 0.3%, |
| Si | up to 0.3%, impurities and balance aluminium. |

All patents, publications and abstracts cited above are incorporated herein by reference in their entireties. Various embodiments of the invention have been described in fulfillment of the various objectives of the invention. It should be recognized that these embodiments are merely illustrative of the principles of the present invention. Numerous modifications and adaptions thereof will be readily apparent to those skilled in the art without departing from the spirit and scope of the present invention as defined in the following claims.

What is claimed is:

1. A method of manufacturing an aluminium alloy rolled product of a heat-treatable aluminium alloy having a thickness of at least 1 mm, comprising the steps of:

(a) semi-continuous casting a heat-treatable aluminium alloy into a rolling ingot having a thickness of at least 250 mm;

(b) preheating and/or homogenizing of the rolling ingot to a peak metal temperature (PMT) of less than 530°° C., wherein after said preheating and/or homogenizing the rolling ingot exhibits a specific energy associated with a Differential Scanning Calorimetry (DSC) signal less than 2 J/g in absolute value;

(c) hot rolling of the rolling ingot in multiple hot rolling steps into a hot rolled product having a final rolling gauge of at least 10 mm, wherein hot rolling occurs in at least three hot rolling steps whereby the hot rolled product during at least one of the last three rolling steps has a temperature less than 50° C. below PMT (° C.);

(d) quenching of the hot rolled product at final rolling gauge from hot-mill exit temperature to below 175° C.;

(e) optionally stress relieving of the quenched and hot rolled product at final rolling gauge; and (f) ageing of the quenched and optionally stress relieved hot rolled product.

2. The method according to claim 1, wherein the method is free from any solution heat-treatment following the hot rolling to a final hot rolling gauge of step (c).

3. The method according to claim 1, wherein the quenching during step (d) is performed in-line with at least the last hot rolling step.

4. The method according to claim 1, wherein the aluminium alloy is selected from the group of 2XXX-, 6XXX, and 7XXX-series aluminium alloys.

5. The method according to claim 1, wherein after said preheating and/or homogenizing, the rolling ingot exhibits a specific energy associated with a DSC signal less than 1.0 J/g in absolute value.

6. The method according to claim 1, wherein for 2XXX-series aluminum alloy products the PMT for preheating and/or homogenizing is at a temperature of from 430° C. to 505° C., and wherein for 7XXX-series aluminium alloy products the PMT for preheating and/or homogenizing is at a temperature of from 430° C. to 490° C.

7. The method according to claim 1, wherein the hot-mill entry temperature is less than 40° C. below the PMT of the aluminium alloy.

8. The method according to claim 1, wherein the hot-mill exit temperature of the hot rolled product at final rolling gauge is less than 40° C. below the PMT of the aluminium alloy.

9. The method according to claim 1, wherein step (e) is performed and wherein during step (e) the stress relieving is by stretching in a range of 0.5% to 8% of its original length.

10. The method according to claim 1, wherein the hot rolled product at final hot rolling gauge is 25.4 mm or more.

11. The method according to claim 1, wherein during step (c) the rolling ingot is hot rolled in a first series of hot rolling steps to an intermediate hot rolled gauge, followed by an intermediate heating step and then in a second series of hot rolling steps hot rolled to final hot rolled gauge of at least 10 mm.

12. The method according to claim 11, wherein the intermediate heating step is to less than 40° C. below the PMT of the aluminium alloy.

13. The method according to claim 1, wherein the aluminium alloy is a 2XXX-series aluminium alloy having composition comprising, in wt. %:

| | |
|---|---|
| Cu | 1.9% to 7%, |
| Mg | 0.3% to 2%, |
| Mn | up to 1.2%, |
| Si | up to 0.4%, |
| Fe | up to 0.4%, |
| Cr | up to 0.35%, |
| Zn | up to 0.4%, |
| Ti | up to 0.15%, |
| Zr | up to 0.25, |
| V | up to 0.25%, balance being aluminium and impurities. |

14. The method according to claim 1, wherein the aluminium alloy is a 6XXX-series aluminium alloy having a composition comprising, in wt. %:

| | |
|---|---|
| Si | 0.2% to 1.7%, |
| Mg | 0.1% to 1.5%, |
| Fe | up to 0.5%, |
| Cu | up to 1.0%, |
| Mn | up to 1.0%, |
| Cr | up to 0.3%, |
| Ti | up to 0.15%, |
| Zn | up to 1.0%, balance being aluminium and impurities. |

15. The method according to claim 1, wherein the aluminium alloy is a 7XXX-series aluminium alloy having a composition comprising, in wt. %:

| | |
|---|---|
| Zn | 4% to 9.8%, |
| Mg | 1% to 3%, |
| Cu | up to 2.5%, |

and optionally one or more elements selected from the group consisting of:

| | |
|---|---|
| Zr up to 0.3%, Cr up to 0.3%, Mn up to 0.45%, | |
| Ti up to 0.15%, Sc up to 0.5%, and Ag up to 0.5%, | |
| Fe | up to 0.3%, |
| Si | up to 0.3%, balance being aluminum and impurities. |

* * * * *